US010481548B2

(12) United States Patent
Murata

(10) Patent No.: US 10,481,548 B2
(45) Date of Patent: Nov. 19, 2019

(54) WASTE TONER COLLECTING DEVICE AND IMAGE FORMING APPARATUS

(71) Applicant: KYOCERA Document Solutions Inc., Osaka-shi, Osaka (JP)

(72) Inventor: Koji Murata, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/163,138

(22) Filed: Oct. 17, 2018

(65) Prior Publication Data

US 2019/0121281 A1 Apr. 25, 2019

(30) Foreign Application Priority Data

Oct. 20, 2017 (JP) ..... 2017-203375

(51) Int. Cl.
*G03G 21/12* (2006.01)
*G03G 21/00* (2006.01)

(52) U.S. Cl.
CPC ..... *G03G 21/12* (2013.01); *G03G 21/0005* (2013.01)

(58) Field of Classification Search
CPC ..... G03G 21/12; G03G 21/0005
See application file for complete search history.

(56) References Cited

U.S. PATENT DOCUMENTS 8,620,168 B2 * 12/2013 Itagaki ..... G03G 15/553 399/35
8,929,755 B2 * 1/2015 Itagaki ..... G03G 21/105 399/35
2009/0252526 A1 10/2009 Kadowaki
2017/0146945 A1 * 5/2017 Takeuchi ..... G03G 15/556

FOREIGN PATENT DOCUMENTS

JP 2009251088 A 10/2009

* cited by examiner

*Primary Examiner* — Walter L Lindsay, Jr.
*Assistant Examiner* — Arlene Heredia
(74) *Attorney, Agent, or Firm* — Alleman Hall Creasman & Tuttle LLP

(57) ABSTRACT

In a waste toner collecting device, primary cleaning devices and a secondary cleaning device remove residual toner that has remained on photoconductor drums and an intermediate transfer belt, respectively. A conveyance path guides the residual toner in a downstream direction. A toner container stores, as waste toner, the residual toner discharged from a downstream end of the conveyance path. A toner amount sensor outputs a detection signal whose level changes in correspondence with an amount of the waste toner. A derivation portion derives an accumulated value of the residual toner based on image data each time an image formation is performed. A determination portion determines whether or not an abnormality has occurred in the waste toner collecting device based on the level of the detection signal and the accumulated value.

7 Claims, 9 Drawing Sheets

FIG. 6

T

| DETERMINATION NUMBER N | NUMERICAL RANGE | |
|---|---|---|
| | FIRST REFERENCE VALUE (LOWER LIMIT VALUE) | SECOND REFERENCE VALUE (UPPER LIMIT VALUE) |
| 1 | R1 | R2 |
| 2 | R1 | R2 |
| : | : | : |
| 10 | R1 | R2 |

T

FIG. 7

| DETERMINATION NUMBER N | FIRST NUMERICAL RANGE | | SECOND NUMERICAL RANGE | | THIRD NUMERICAL RANGE | |
|---|---|---|---|---|---|---|
| | FIRST REFERENCE VALUE (LOWER LIMIT VALUE) | SECOND REFERENCE VALUE (UPPER LIMIT VALUE) | LOWER THAN THIRD REFERENCE VALUE | HIGHER THAN SECOND REFERENCE VALUE | EQUAL TO OR HIGHER THAN THIRD REFERENCE VALUE | LOWER THAN FIRST REFERENCE VALUE |
| 1 | R1 | R2 | R3 | R2 | R3 | R1 |
| 2 | R1 | R2 | R3 | R2 | R3 | R1 |
| : | : | : | : | : | : | : |
| 10 | R1 | R2 | R3 | R2 | R3 | R1 |

WASTE TONER COLLECTING DEVICE AND IMAGE FORMING APPARATUS

INCORPORATION BY REFERENCE

This application is based upon and claims the benefit of priority from the corresponding Japanese Patent Application No. 2017-203375 filed on Oct. 20, 2017, the entire contents of which are incorporated herein by reference.

BACKGROUND

The present disclosure relates to a waste toner collecting device configured to collect waste toner, and to an electrophotographic image forming apparatus.

In general, in an electrophotographic image forming apparatus, a toner image is formed on an image carrier such as a photoconductor drum. The toner image is transferred to a transferred body such as a sheet. In most cases, residual toner is generated on the image carrier. In a waste toner collecting device, the residual toner is removed by a cleaning device, conveyed in a conveyance path, and stored in a toner container as waste toner.

In the waste toner collecting device, a toner amount sensor is provided. The toner amount sensor outputs a detection signal indicating an amount of waste toner. The image forming apparatus executes a full-capacity detection to determine, based on the detection signal, whether or not the toner container is full of the waste toner.

SUMMARY

A waste toner collecting device according to an aspect of the present disclosure includes a cleaning device, a conveyance path, a toner container, a toner amount sensor, a derivation portion, and a determination portion. The cleaning device removes residual toner that has remained on an image carrier. The conveyance path guides, in a downstream direction, the residual toner removed by the cleaning device. The toner container stores, as waste toner, the residual toner discharged from a downstream end of the conveyance path. The toner amount sensor outputs a detection signal whose level changes in correspondence with an amount of the waste toner. The derivation portion, each time an image formation is performed, derives an accumulated value of the residual toner by deriving and accumulating an amount of the residual toner based on image data used in the image formation. The determination portion determines whether or not an abnormality has occurred in the waste toner collecting device based on the level of the detection signal and the accumulated value.

An image forming apparatus according to another aspect of the present disclosure includes an image former and the waste toner collecting device. The image former forms a toner image on the image carrier based on the image data, and transfers the toner image to a transferred body.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 6 is a diagram showing a configuration of a table stored in the control circuit shown in FIG. 4.

FIG. 7 is a diagram showing a configuration of a table according to a first other embodiment.

DETAILED DESCRIPTION

The following describes embodiments of the present disclosure with reference to the accompanying drawings for the understanding of the present disclosure. It should be noted that the following embodiments are examples of specific embodiments of the present disclosure and should not limit the technical scope of the present disclosure.

Embodiment

Figure 1:
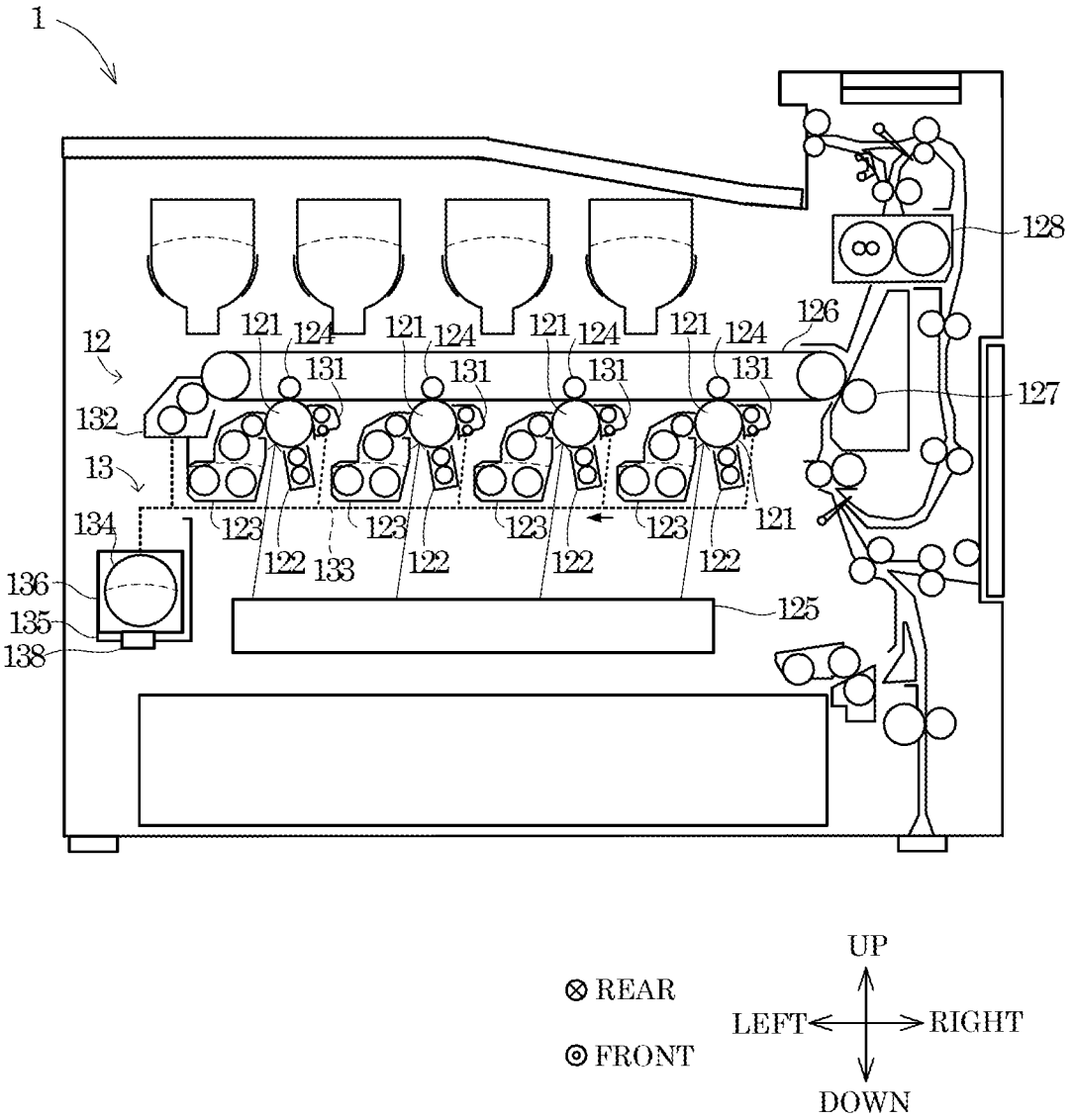
FIG. 1 is a diagram showing configurations of a waste toner collecting device and an image forming apparatus according to an embodiment of the present disclosure.

In FIG. 1, an image forming apparatus 1 is, for example, a copier, a printer, or a multifunction peripheral. The multifunction peripheral has a plurality of functions such as a copy function, a print function, and a facsimile function. The image forming apparatus 1 includes a control circuit 11, an image former 12, and a waste toner collecting device 13.

The control circuit 11 is, for example, an integrated circuit that includes a CPU, a ROM, a RAM, and non-volatile memory. The CPU executes a program that has been stored in advance in the ROM, by using the RAM as a work area. The CPU records various types of data onto the non-volatile memory. The CPU comprehensively controls image formation in the image forming apparatus 1. Further, the CPU performs a self-diagnosis, in addition to a full-capacity detection, to determine whether or not an abnormality has occurred in the waste toner collecting device 13.

It is noted that the control circuit 11 may be an electronic circuit such as an ASIC (Application Specific Integrated Circuit) or a DSP (Digital Signal Processor).

With reference to FIG. 1, a sheet is fed into the image former 12. The image former 12 includes, for each of a plurality of colors, a photoconductor drum 121, a charger 122, a developing unit 123, a primary transfer unit 124, an exposure device 125, an intermediate transfer belt 126, a secondary transfer unit 127, and a fixing unit 128. The plurality of colors are yellow, magenta, cyan, and black.

The image former 12 forms toner images of the plurality of colors respectively on circumferential surfaces of the photoconductor drums 121 by an electrophotographic system and a tandem system based on image data input from the control circuit 11, the photoconductor drums 121 being a first example of an image carrier. The image former 12 performs a primary transfer process to transfer toner images from the photoconductor drums 121 onto a same area on the intermediate transfer belt 126, thereby forming a composite toner image, the intermediate transfer belt 126 being a first example of a transferred body. The image former 12 performs a secondary transfer process to transfer the composite toner image from the intermediate transfer belt 126 onto the sheet, the intermediate transfer belt 126 being a second example of the image carrier, the sheet being a second example of the transferred body. The image former 12 generates a print by fixing the composite toner image to the sheet. The image former 12 discharges the print to the outside of the image forming apparatus 1. It is noted that the image former 12 may form the composite toner image by a 4-cycle electrophotographic system, or may form only a monochrome image.

In the primary transfer process, part of the toner images of the plurality of colors remains on the photoconductor drums 121 as residual toner, without being transferred to the intermediate transfer belt 126. In addition, in the secondary transfer process, part of the composite toner image remains on the intermediate transfer belt 126 as residual toner, without being transferred to the sheet.

The waste toner collecting device 13 is an appratus for collecting the residual toner, and as shown in FIG. 1, includes, in addition to the control circuit 11, primary cleaning devices 131 respectively for the plurality of colors, a secondary cleaning device 132, a conveyance path 133, a toner container 134, a supporter 135, a container cover 136, a driving force transmitter 137, and a toner amount sensor 138. It is noted that the conveyance path 133 is indicated by a dotted line in FIG. 1.

The primary cleaning devices 131 and the secondary cleaning device 132 are each an example of a cleaning device. After the primary transfer process, the primary cleaning devices 131 remove the residual toner that has remained by the image formation on the photoconductor drums 121 for the corresponding colors, by, for example, a blade system or a brush system. After the secondary transfer process, the secondary cleaning device 132 removes the residual toner that has remained by the image formation on the intermediate transfer belt 126, by, for example, the blade system. The residual toner is fed into the conveyance path 133 that is provided below the primary cleaning devices 131 and the secondary cleaning device 132.

Figure 2:
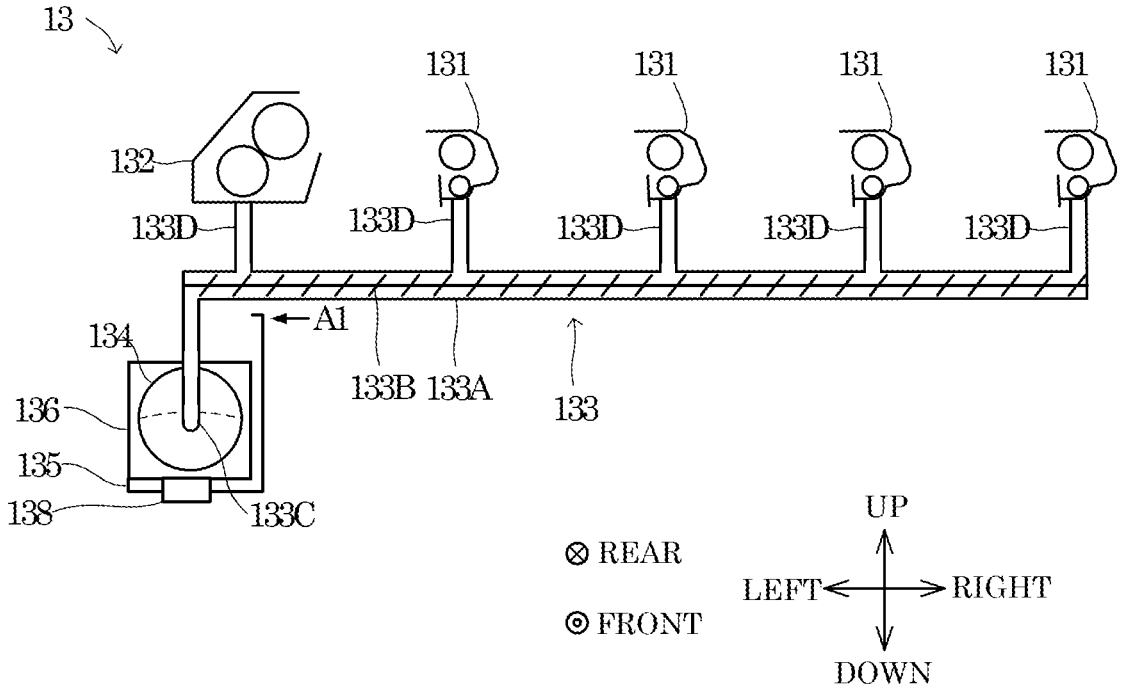
FIG. 2 is a diagram showing a conveyance path shown in FIG. 1 and its peripheral configuration.

The conveyance path 133 is formed by, for example, a cylindrical tube. As shown in FIG. 2, in the conveyance path 133, the residual toner is guided in a downstream direction A1 indicated by the arrow A1 toward the toner container 134 that is described below. Specifically, the conveyance path 133 includes a horizontal path 133A. The horizontal path 133A extends in a left-right direction below the primary cleaning devices 131 and the secondary cleaning device 132 and is disposed in a horizontal attitude. A conveyance screw 133B and the like are provided in the horizontal path 133A. The conveyance screw 133B conveys the residual toner fed into the conveyance path 133, in the downstream direction A1. This allows the residual toner to be guided in the conveyance path 133. In addition, in the conveyance path 133, the residual toner is discharged from a downstream end 133C that is an end in the downstream direction A1. It is noted that the downstream end 133C is communicated with the toner container 134 that is described below.

In addition, the conveyance path 133 includes a plurality of relay paths 133D. The plurality of relay paths 133D extend downward respectively from housings of the primary cleaning devices 131 and the secondary cleaning device 132. The plurality of relay paths 133D are communicated with the horizontal path 133A. The residual toner discharged from the primary cleaning devices 131 and the secondary cleaning device 132 is fed into the plurality of relay paths 133D and drops into the horizontal path 133A.

In addition, the conveyance path 133 has a predetermined capacity inside. In addition, an upper limit value of an allowable range for the amount of residual toner allowed to stay in the conveyance path 133 is determined. Furthermore, a weight value converted from the upper limit value is determined as a weight allowance Q1. If residual toner exceeding the weight allowance Q1 in amount stays in the conveyance path 133, the risk of a failure occurring in the image forming apparatus 1 increases. It is noted that the upper limit value and the weight allowance Q1 are preliminarily acquired through experiments or the like in the design stage of the waste toner collecting device 13.

As shown in FIG. 1, the toner container 134 is provided below the conveyance path 133 in a state where it is attached to the image forming apparatus 1 (hereinafter, the state is referred to as an attached state). Specifically, the toner container 134, below the downstream end 133C, extends in a front-rear direction perpendicular to the direction in which the horizontal path of the conveyance path 133 extends. In addition, the toner container 134 has the shape of a bottle elongated in the front-rear direction.

Figure 3:
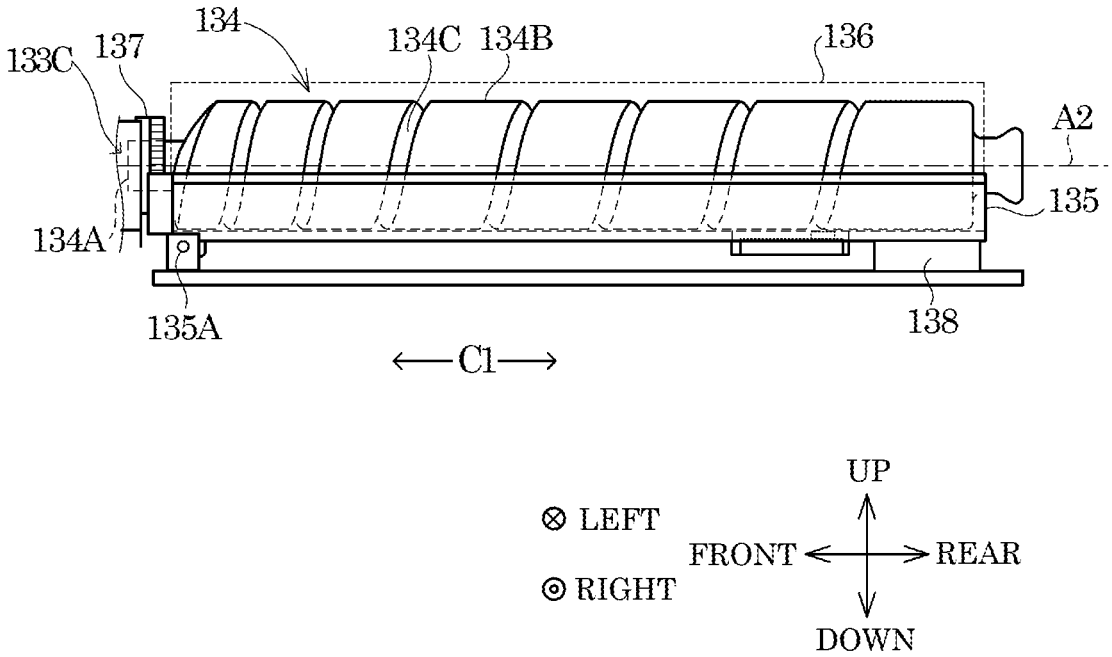
FIG. 3 is a side diagram showing a toner container shown in FIG. 1 and its peripheral configuration.

In addition, as shown in FIG. 3, the toner container 134 includes an opening 134A, a main body 134B, and a protrusion 134C. The opening 134A is provided at an end of the toner container 134 in a longitudinal direction C1 of the toner container 134. The opening 134A has an opening through which the residual toner flows in from the downstream end 133C.

The main body 134B extends toward the other end in the longitudinal direction C1 with respect to the opening 134A, and has an approximate cylindrical shape. An inner space of the main body 134B is communicated with the opening. Waste toner that flows in from the opening 134A is stored in the inner space of the main body 134B.

The protrusion 134C is formed on an inner circumferential surface of the main body 134B. The protrusion 134C is formed in a spiral shape in such a way as to protrude toward a central axis A2 of the main body 134B and proceed toward the other end in the longitudinal direction C1 while turning around the central axis A2 in a predetermined turning direction.

The toner container 134 has a predetermined capacity V1. In addition, a weight value converted from an upper limit value of an allowable range for the amount of waste toner capable of being stored in the toner container 134, is determined as a full-capacity amount Q2.

The toner container 134 is supported in a detachable manner by the supporter 135 and the container cover 136 in the inside of the image forming apparatus 1. Specifically, the supporter 135 extends in the front-rear direction from below the downstream end 133C of the conveyance path 133. The supporter 135 is attached to a frame (not shown) of the image forming apparatus 1 via a support shaft 135A that extends parallel to the left-right direction. It is noted that the support shaft 135A is provided in the vicinity of an end 135B of the supporter 135 on the downstream end 133C side. In addition, in the supporter 135, an end 135C that is opposite to the end 135B is configured to swing in an up-down direction with the support shaft 135A as the center of rotation.

The container cover 136 is attached to an upper part of the supporter 135 so as to extend in the front-rear direction. A space is formed between the supporter 135 and the container cover 136 such that the toner container 134 is attached in the space. The toner container 134 is attached in the space and disposed so that the central axis A2 is parallel to the front-rear direction of the image forming apparatus 1. In addition, the supporter 135 and the container cover 136 support the toner container 134 from below and above in the up-down direction.

In the state where the toner container 134 is attached in the space, the opening 134A is communicated with the downstream end 133C of the conveyance path 133. In addition, the toner container 134 is configured to rotate in the space in a predetermined rotation direction with respect to the central axis A2.

The image formation can be executed after the toner container 134 is attached. In case that the image formation is started, the residual toner discharged from the conveyance path 133 starts to flow, as the waste toner, into the toner container 134 from the opening 134A. In addition, during the image formation, a rotational force is supplied from the driving force transmitter 137 to the opening 134A, and the toner container 134 rotates. With this configuration, the waste toner is conveyed by the rotating protrusion 134C from the opening 134A toward the other end in the longitudinal direction C1 and is stored in the main body 134B.

The toner amount sensor 138 is a piezoelectric sensor and is provided on a lower part of the end 135C of the supporter 135. The toner amount sensor 138 outputs a detection signal to the control circuit 11, wherein the detection signal changes in level in correspondence with the amount of the waste toner (hereinafter merely referred to as "waste toner amount") in the toner container 134. Specifically, since the rear-end side of the toner container 134 moves in the up-down direction by the action of the support shaft 135A, a load corresponding to the weight of the waste toner amount is applied to the toner amount sensor 138. The level of the detection signal changes in correspondence with the load applied to the toner amount sensor 138.

It is noted that the toner amount sensor 138 is not limited to the piezoelectric sensor, but may be a magnetic permeability sensor, a transmission type optical sensor, or a reflection type optical sensor. Here, if the detection signal indicates an abnormal level, an accurate full-capacity detection cannot be executed, and, as a result, for example, an overflow of the waster toner from the toner container 134 may occur, thus the risk of a failure occurring in the image forming apparatus 1 increases.

Meanwhile, an abnormality may occur in the waste toner collecting device 13. As an example of the abnormality, the waste toner may not be normally conveyed in the conveyance path 133 of the waste toner collecting device 13, or the toner amount sensor 138 may not normally detect the toner amount.

Specifically, if the waste toner is normally conveyed in the conveyance path 133, the residual toner not exceeding the weight allowance Q1 is conveyed in the conveyance path 133 toward the toner container 134. On the other hand, if the residual toner in the conveyance path 133 exceeds the weight allowance Q1, an excessive amount of residual toner stays in the conveyance path 133 and becomes easy to be solidified. This may lead to a rotation failure of the conveyance screw in the conveyance path 133, or a clog of the residual toner, thereby increasing a possibility that a failure to convey the residual toner may occur.

In addition, if the toner amount sensor 138 detects the toner amount normally, the detection signal indicates a level that corresponds to the waste toner amount. On the other hand, if the toner amount sensor 138 does not detect the toner amount normally, namely, if the toner amount sensor 138 has a malfunction, the detection signal may indicate an abnormal value.

If the image forming apparatus 1 executes the image formation in a state where an abnormality is generated in the waste toner collecting device 13, it increases the risk of a failure in the image forming apparatus 1.

In addition, since the full-capacity detection only detects the waste toner amount in the toner container 134, it is difficult to determine whether a conveyance failure or a malfunction has occurred, or merely the original amount of the residual toner is small.

Figure 4:
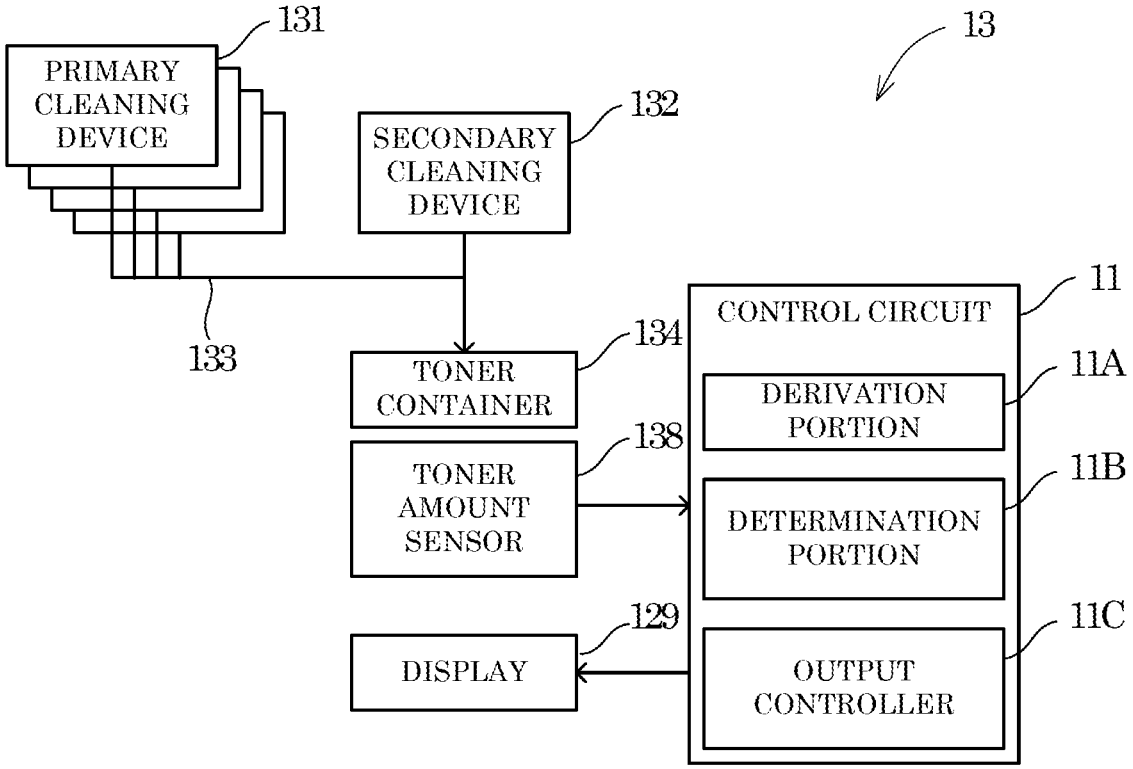
FIG. 4 is a block diagram showing a main part of the waste toner collecting device shown in FIG. 1

In view of the above-mentioned matter, the waste toner collecting device 13 is configured to determine whether or not an abnormality has occurred in the waste toner collecting device 13 by performing the self-diagnosis in addition to the full-capacity detection. As shown in FIG. 4, in the waste toner collecting device 13, the control circuit 11 includes a derivation portion 11A, a determination portion 11B, and an output controller 11C. Specifically, the control circuit 11 functions as the derivation portion 11A, the determination portion 11B, and the output controller 11C by executing the program. It is noted that FIG. 4 also shows a display 129 that is provided in the image forming apparatus 1 and configured to output various types of information to the user. The following describes a processing procedure of the self-diagnosis in detail with reference to FIG. 4 and FIG. 5.

Figure 5:
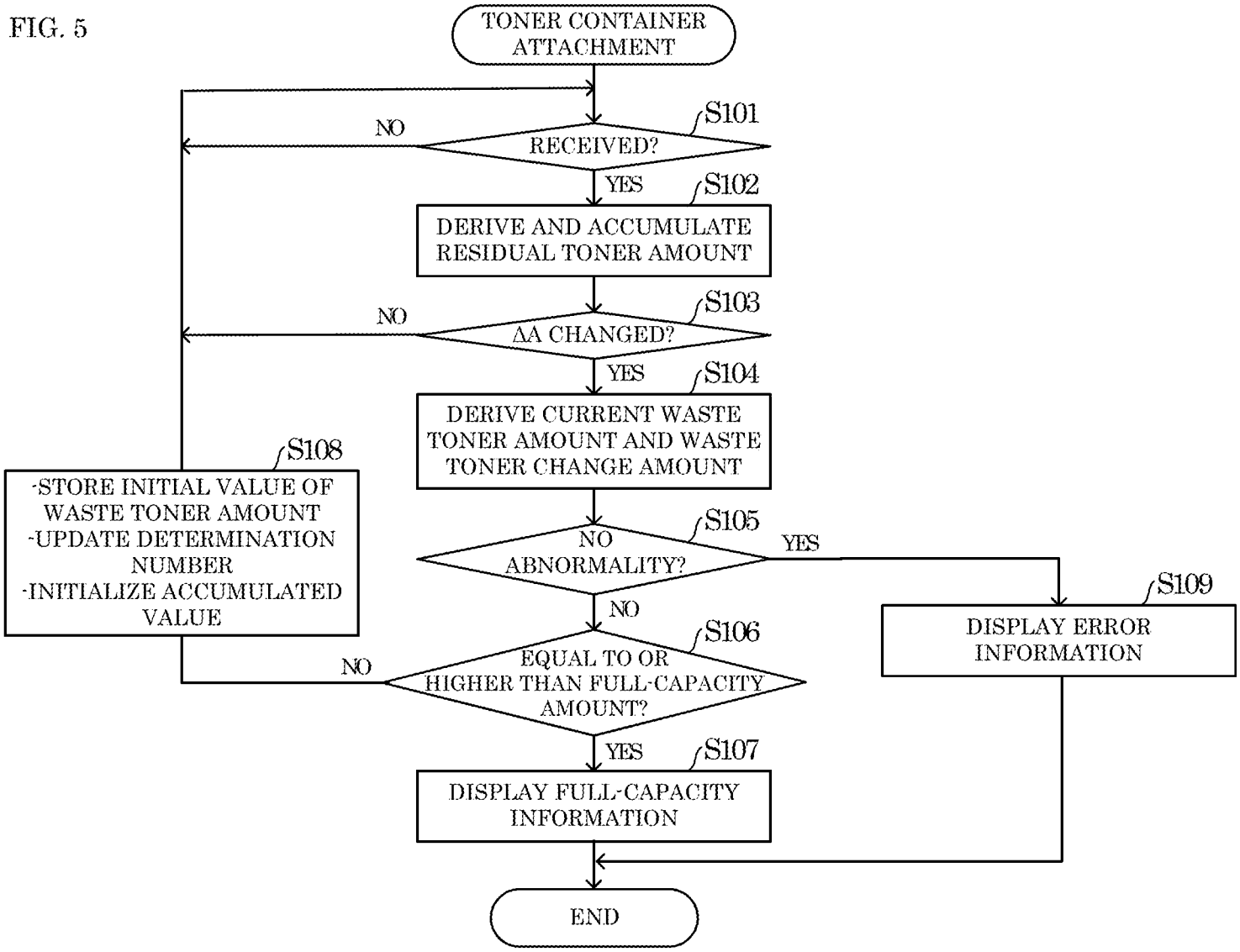
FIG. 5 is a flowchart showing a procedure of a self-diagnosis process performed by a control circuit shown in FIG. 4.

In FIG. 5, after the toner container 134 is attached, the derivation portion 11A of the control circuit 11 executes step S101. First, the derivation portion 11A determines whether or not image data has been received from an external apparatus. The external apparatus is, for example, a personal computer (not shown) connected to the image forming apparatus 1 via a network. As another example, the external apparatus may be a scanner (not shown) provided in the image forming apparatus 1.

Upon determining in step S101 that image data has not been received, the derivation portion 11A executes step S101 again. On the other hand, upon determining that image data has been received, the derivation portion 11A moves the process to step S102.

Next, each time the image formation is executed, the derivation portion 11A derives an amount of residual toner (hereinafter, merely referred to as "residual toner amount") generated on the image carrier (namely, the photoconductor drums 121 respectively for the plurality of colors and the intermediate transfer belt 126), and accumulates the derived residual toner amount (step S102). In the following, the process of step S102 is described in detail.

First, the derivation portion 11A, for example, derives a dot count number based on the image data. The dot count number is a total of dots that are formed on the photoconductor drums 121 for the plurality of colors by a modulated light from the exposure device 125, the dot count number being derived for each sheet used in the image formation.

Next, the derivation portion 11A derives an amount of toner corresponding to the dot count number, as a supplied toner amount that represents an amount of toner supplied from the developing devices 123 for the plurality of colors to the photoconductor drums 121 for the plurality of colors.

Next, the derivation portion 11A derives the residual toner amount that represents an amount of residual toner generated in the image formation, by reducing, from the supplied toner amount, a value obtained by multiplying the supplied toner amount by a primary transfer efficiency and a secondary transfer efficiency. The primary transfer efficiency indicates a ratio of an amount of toner that moves from the photoconductor drums 121 for the plurality of colors to the intermediate transfer belt 126. The secondary transfer efficiency indicates a ratio of an amount of toner that moves from the intermediate transfer belt 126 to the sheet. The primary transfer efficiency and the secondary transfer efficiency are obtained from values of transfer current that flows through the primary transfer unit 124 and the secondary transfer unit 127, ambient temperature of the image forming apparatus 1 and the like. It is noted that the primary transfer efficiency and the secondary transfer efficiency may be experimental values that are obtained in the design stage, or may be obtained by using a predetermined calculation formula each time step S102 is executed.

The derivation portion 11A updates an accumulated value of the residual toner amount that was derived during a time period from a replacement of the toner container 134 to a reception of image data, by accumulating the residual toner amount derived in step S102 to the accumulated value. After the accumulation, the derivation portion 11A ends the process of step S102 and moves the process to step S103.

The determination portion 11B, for stepwise weight detection, determines whether or not the accumulated value obtained in step S102 has changed by a predetermined increment ΔA (step S103). The increment ΔA is determined arbitrarily in advance not to exceed the full-capacity amount Q2. Specifically, the increment ΔA is a value obtained by dividing the full-capacity amount Q2 by a predetermined determination number N. The determination number N is determined preliminarily and indicates how many times step S105 can be performed at maximum during the time period from the replacement of the toner container 134 to the reception of the image data, the step S105 being described below. In the present embodiment, the determination number N is 10.

Upon determining that the accumulated value has not changed by the increment ΔA, the determination portion 11B returns the process to step S101. On the other hand, upon determining that the accumulated value has changed by the increment ΔA, the determination portion 11B moves the process to step S104.

In step S104, the determination portion 11B receives the detection signal and acquires a level of the detection signal. The determination portion 11B derives the waste toner amount based on the acquired level. Hereinafter, the waste toner amount derived in step S104 is referred to as "current waste toner amount".

Next, the determination portion 11B reads an initial value of the waste toner amount stored in, for example, the RAM of the control circuit 11, and then derives, as a waste toner change amount, a difference between the current waste toner amount and the initial value (step S104).

Next, the determination portion 11B determines whether or not an abnormality has occurred in the waste toner collecting device 13, more specifically, whether an abnormality has occurred in the conveyance path 133 or the toner amount sensor 138, based on the level of the detection signal and the accumulated value (step S105). In the following, the process of step S105 is described in detail.

A table T shown in FIG. 6 is stored in advance in the non-volatile memory or the like. In the table T, a numerical range from equal to or higher than a first reference value R1 to equal to or lower than a second reference value R2 is written for each value of the determination number N. The first reference value R1 is determined arbitrarily in advance not to exceed the increment ΔA, and indicates whether or not an excessive amount of residual toner stays in the conveyance path 133 or whether or not the detection signal indicates an abnormal value.

More specifically, the first reference value R1 is determined based on the increment ΔA and the weight allowance Q1. This makes it possible to output error information before the residual toner amount exceeds the weight allowance Q1, wherein the error information is described below.

Furthermore specifically, the first reference value R1 is obtained by reducing a value that is obtained by dividing the weight allowance Q1 by the determination number N, from the increment ΔA. The first reference value R1 allows the waste toner collecting device 13 to notify the user that the residual toner amount is increasing at a pace of over the weight allowance Q1, in an early stage after the replacementy of the toner container 134, via an error message that is described below.

In addition, the second reference value R2 is obtained by adding a predetermined margin to the increment ΔA. The second reference value R2 allows the waste toner collecting device 13 to determine not only that a conveyance failure has occurred but also that the detection signal indicates an abnormal value. Specifically, the waste toner amount based on the detection signal basically does not exceed the residual toner amount. As a result, if the waste toner change amount has exceeded the second reference value R2, it is possible to regard that the toner amount sensor 138 has a malfunction.

If the waste toner change amount is within the numerical range, the determination portion 11B determines that the waste toner collecting device 13 does not have an abnormality. That is, the determination portion 11B determines that the conveyance failure or the malfunction has not occurred. Thereafter, the determination portion 11B moves the process to step S106.

On the other hand, if the waste toner change amount is not within the numerical range, the determination portion 11B determines that the waste toner collecting device 13 has an abnormality. That is, the determination portion 11B determines that the conveyance failure or the malfunction has occurred. Thereafter, the determination portion 11B moves the process to step S109.

Next, the determination portion 11B determines whether or not the waste toner amount is equal to or higher than the full-capacity amount Q2 (step S106). Upon determining that the waste toner amount is not equal to or higher than the full-capacity amount Q2, the determination portion 11B moves the process to step S108. On the other hand, upon determining that the waste toner amount is equal to or higher than the full-capacity amount Q2, the determination portion 11B moves the process to step S107.

Next, the output controller 11C displays, on the display 129, full-capacity information that urges to replace the toner container 134 (step S107), and then ends the process shown in FIG. 5. It is noted that if a predetermined time has elapsed since step S107, the control circuit 11 may prohibit the image formation from being performed thereafter.

In step S108, the determination portion 11B stores the waste toner amount derived in step S104 in the RAM or the like as the initial value of the waste toner amount by overwriting the old value. In addition, the determination portion 11B increments the determination number N by 1 (one), and returns the accumulated value to the initial value 0 (zero) (step S106). Thereafter, the determination portion 11B returns the process to step S101.

In addition, in step S109, the output controller 11C displays, on the display 129, error information indicating that the conveyance failure or the malfunction has occurred, and ends the process shown in FIG. 5. This allows the waste toner collecting device 13 to notify the user that the conveyance failure or the malfunction has occurred.

According to the waste toner collecting device 13, the control circuit 11, with a self-diagnosis, determines that an abnormality has occurred (specifically, the conveyance failure or the malfunction has occurred) in the waste toner collecting device 13, and displays the fact. In this way, it is possible to reduce the risk of a failure occurring in the image forming apparatus.

In addition, since there is no need to additionally have a sensor dedicated to the self-diagnosis, it is possible to refrain from increasing the number of parts of the waste toner collecting device 13.

In addition, in the self-diagnosis, each time the accumulated value increases by the increment ΔA, it is determined whether or not the waste toner change amount is within the numerical range (step S105). The fact that the waste toner change amount is not within the numerical range means that at a point in time if step S105 is executed, a malfunction has occurred in the toner amount sensor 138, or means that the amount of the waste toner staying in the conveyance path 133 will exceed the weight allowance Q1 in due course if the image formation is continued. With the self-diagnosis based on the increment ΔA, the waste toner collecting device 13 can notify the user, in an early stage, that an abnormality has occurred in the waste toner collecting device 13.

It is noted that in the table T, a same value of the first reference value R1 may not be written for each value of the determination number N. For example, in the table T, the first reference value R1 may become lower as the determination number N increases. Specifically, the first reference value R1 is close to the increment ΔA if the determination number N is low, and is separate from the increment ΔA if the determination number N is high. With this configuration, if the determination number N is low, namely, if it is considered that there is a sufficient period until the weight allowance Q1 is reached, the error information is hardly displayed.

In addition, if it is determined in step S105 that the waste toner change amount is not within the numerical range, a cleaning failure may have occurred in the primary cleaning devices 131 or the secondary cleaning device 132. As a result, the error information may indicate not only that the conveyance failure or the malfunction has occurred, but also that a cleaning failure has occurred.

The following describes other embodiments of the present disclosure. It is noted that in the other embodiments described in the following, components that are the same as those of the above-described embodiment are assigned the same reference signs, and description thereof is omitted.

First Other Embodiment

A table T shown in FIG. 7 is stored in advance in the non-volatile memory or the like. In the table T, a first numerical range, a second numerical range, and a third numerical range are written for each value of the determination number N. The first numerical range is from equal to or higher than the first reference value R1 to equal to or lower than the second reference value R2. The second numerical range is lower than a third reference value R3 or higher than the second reference value R2. The third numerical range is from equal to or higher than the third reference value R3 to lower than the first reference value R1.

The third reference value R3 is lower than the first reference value R1. More specifically, the third reference value R3 is 0, but may be a value that is obtained by adding a predetermined margin to 0, or a value that is obtained by subtracting the predetermined margin from 0. The waste toner amount based on the detection signal basically does not become lower than 0. As a result, by setting the third reference value R3 to 0, if the waste toner change amount is lower than the third reference value R3, it is possible to regard that the toner amount sensor 138 has a malfunction.

Figure 8:
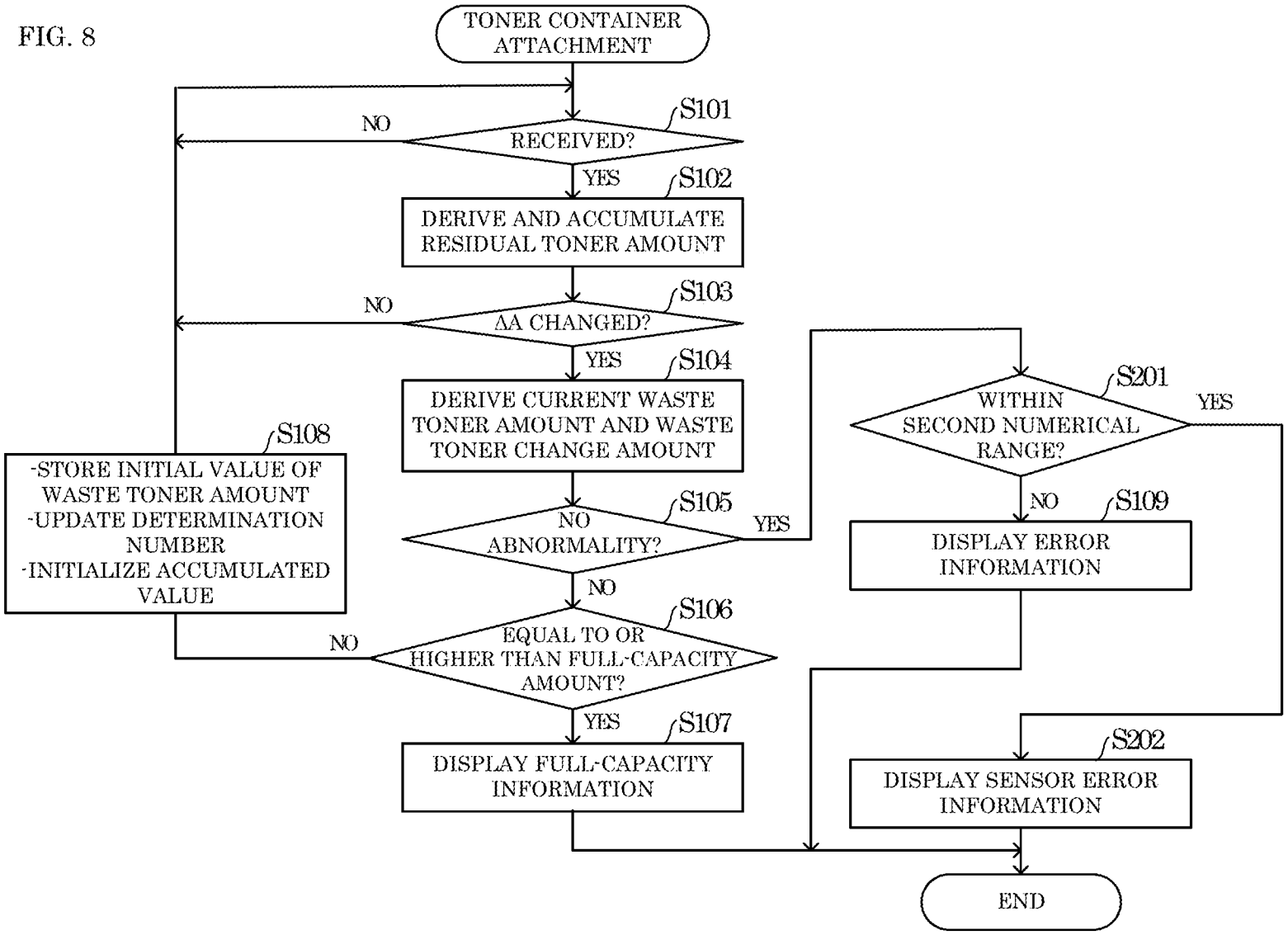
FIG. 8 is a flowchart showing a procedure of a self-diagnosis process according to the first other embodiment.

In step S105 shown in FIG. 8, as in the above-described embodiment, the determination portion 11B moves the process to step S106 upon determining that the waste toner change amount is within the first numerical range. On the other hand, in step S105, the determination portion 11B moves the process to step S201 upon determining that the waste toner change amount is not within the first numerical range.

Next, the determination portion 11B determines whether or not the waste toner change amount is within the second numerical range (Step S201). Upon determining that the waste toner change amount is not within the second numerical range, the determination portion 11B determines that the conveyance failure or the malfunction has occurred, and moves the process to step S109. On the other hand, upon determining that the waste toner change amount is within the second numerical range, the determination portion 11B determines that the malfunction has occurred in the toner amount sensor 138, and moves the process to step S202.

Next, the output controller 11C displays, on the display 129, sensor error information indicating that the malfunction has occurred, and ends the process shown in FIG. 8. With this configuration, the waste toner collecting device 13 can notify the user that the malfunction has occurred.

Second Other Embodiment

Figure 9:
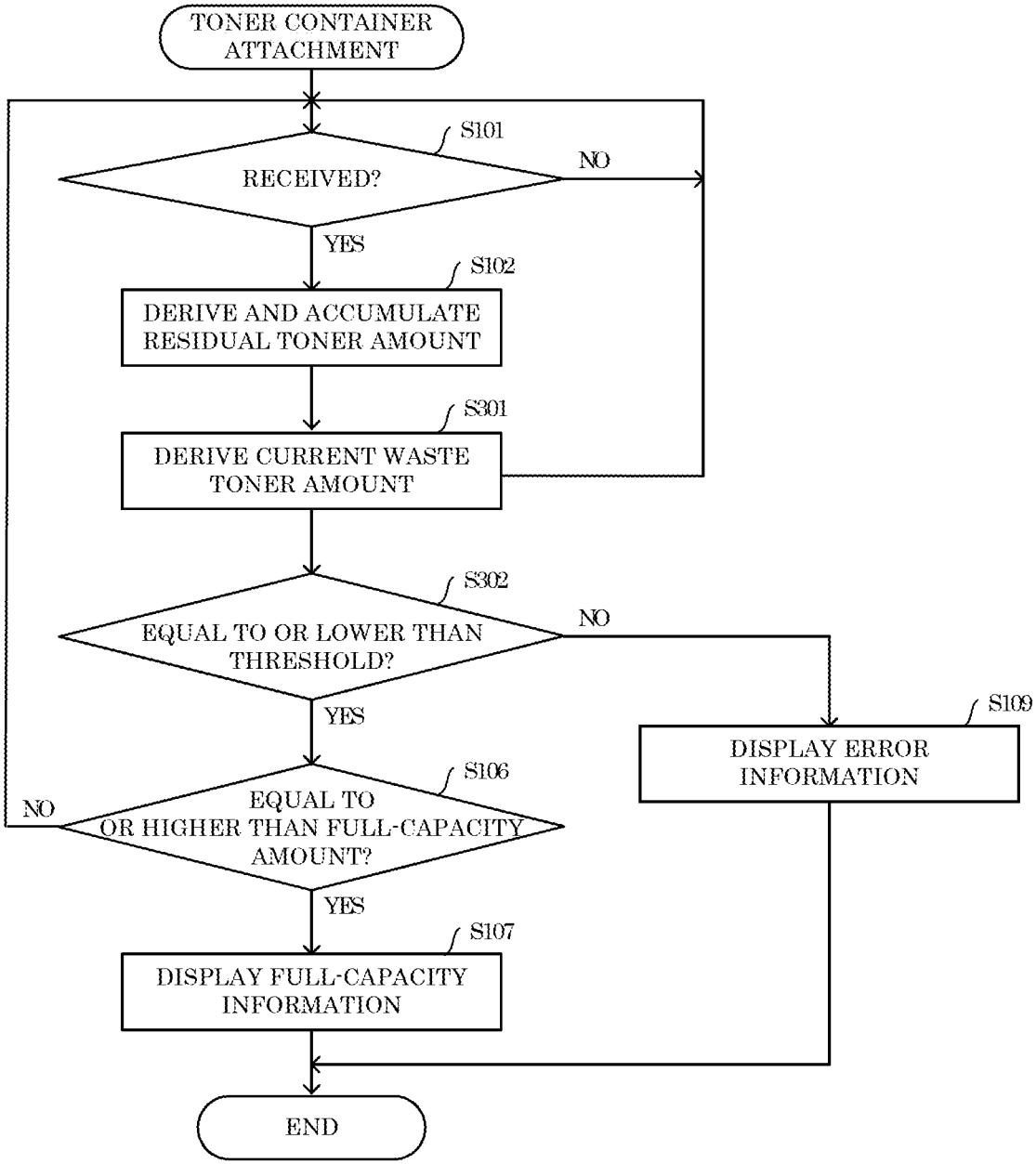
FIG. 9 is a flowchart showing a procedure of a self-diagnosis process according to a second other embodiment.

Following step S102 shown in FIG. 9, the determination portion 11B derives the current waste toner amount (step S301). Thereafter, the determination portion 11B determines whether or not the absolute value of a difference between the accumulated value stored in step S102 and the current waste toner amount is equal to or lower than a predetermined threshold (step S302). The threshold is determined in advance based on the weight allowance Q1. Specifically, the threshold may be the weight allowance Q1 itself, or may be a value obtained by adding a predetermined margin to the weight allowance Q1.

Upon determining that the absolute value is not equal to or lower than the threshold, the determination portion 11B determines that the waste toner collecting device 13 does not have an abnormality, and moves the process to step S109. On the other hand, upon determining that the absolute value is equal to or lower than the threshold, the determination portion 11B determines that the waste toner collecting device 13 has an abnormality, and moves the process to step S107.

With the self-diagnosis shown in FIG. 9, too, it is possible to reduce the risk of a failure occurring in the image forming apparatus. In particular, since it is determined whether or not the conveyance failure or the malfunction has occurred each time the image data is received, it is possible to notify the fact to the user of the image forming apparatus 1 substantially at the same time as the occurrence of the conveyance failure or the malfunction.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A waste toner collecting device comprising:

a cleaning device configured to remove residual toner that has remained on an image carrier;

a conveyance path configured to guide, in a downstream direction, the residual toner removed by the cleaning device;

a toner container configured to store, as waste toner, the residual toner discharged from a downstream end of the conveyance path;

a toner amount sensor configured to output a detection signal whose level changes in correspondence with an amount of the waste toner; and a control circuit configured to:

each time an image formation is performed, derive an accumulated value of the residual toner by deriving and accumulating an amount of the residual toner based on image data used in the image formation;

determine whether or not an abnormality has occurred in the waste toner collecting device based on the level of the detection signal and the accumulated value; and determine whether or not a conveyance failure has occurred in the conveyance path.

2. A waste toner collecting device comprising:

a cleaning device configured to remove residual toner that has remained on an image carrier;

a conveyance path configured to guide, in a downstream direction, the residual toner removed by the cleaning device;

a toner container configured to store, as waste toner, the residual toner discharged from a downstream end of the conveyance path;

a toner amount sensor configured to output a detection signal whose level changes in correspondence with an amount of the waste toner; and a control circuit configured to:

determine whether or not an abnormality has occurred in the waste toner collecting device based on the level of the detection signal and the accumulated value;

determine whether or not an abnormality has occurred in the waste toner collecting device based on the level of the detection signal and the accumulated value;

determine that an abnormality has not occurred in the waste toner collecting device if a waste toner change amount that corresponds to an amount of change of the level of the detection signal made while the accumulated value changes by a predetermined increment, is equal to or higher than a predetermined first reference value and equal to or lower than a predetermined second reference value, and determine that an abnormality has occurred in the waste toner collecting device if the waste toner change amount is lower than the first reference value or higher than the second reference value.

3. The waste toner collecting device according to claim 2, wherein the first reference value is determined based on the increment and an allowable range for an amount of residual toner allowed to stay in the conveyance path.

4. The waste toner collecting device according to claim 2, wherein the control circuit is further configured to determine that an abnormality has occurred in the toner amount sensor if the waste toner change amount is lower than a third reference value or higher than the second reference value, the third reference value being lower than the first reference value.

5. The waste toner collecting device according to claim 1, wherein the control circuit is further configured to:

receive the accumulated value and the detection signal each time the derivation portion derives the accumulated value, derive an amount of the waste toner based on the level of the detection signal, determine that an abnormality has not occurred in the waste toner collecting device if an absolute value of a difference between the accumulated value and the amount of the waste toner is equal to or lower than a predetermined threshold, and determine that an abnormality has occurred in the waste toner collecting device if the absolute value is neither equal to nor lower than the threshold.

6. The waste toner collecting device according to claim 5, wherein the threshold is determined based on an allowable range for an amount of residual toner allowed to stay in the conveyance path.

7. An image forming apparatus comprising:

an image former configured to form a toner image on the image carrier based on the image data, and transfer the toner image to a transferred body; and the waste toner collecting device according to claim 1.

* * * * *